US008764278B2

(12) United States Patent
Fondelius

(10) Patent No.: US 8,764,278 B2
(45) Date of Patent: Jul. 1, 2014

(54) MIXER ASSEMBLY AND METHOD FOR FLOW CONTROL IN A MIXER ASSEMBLY

(75) Inventor: Johan Fondelius, Stockholm (SE)

(73) Assignee: Xylem IP Holdings LLC, White Plains, NY (US)

( * ) Notice: Subject to any disclaimer, the term of this patent is extended or adjusted under 35 U.S.C. 154(b) by 1028 days.

(21) Appl. No.: 12/811,431

(22) PCT Filed: Jan. 12, 2009

(86) PCT No.: PCT/SE2009/050012

§ 371 (c)(1),
(2), (4) Date: Jul. 7, 2010

(87) PCT Pub. No.: WO2009/088356

PCT Pub. Date: Jul. 16, 2009

(65) Prior Publication Data

US 2010/0284241 A1 Nov. 11, 2010

(30) Foreign Application Priority Data

Jan. 11, 2008 (SE) ..... 0800071

(51) Int. Cl.
*B01F 7/06* (2006.01)

(52) U.S. Cl.
USPC ..... 366/270; 366/302

(58) Field of Classification Search
USPC ..... 366/270, 302, 303, 307
See application file for complete search history.

(56) References Cited

U.S. PATENT DOCUMENTS

| | | | | | |
|---|---|---|---|---|---|
| 215,372 | A | * | 5/1879 | Kuehne | 165/109.1 |
| 452,147 | A | * | 5/1891 | Nuebling | 366/303 |
| 614,522 | A | * | 11/1898 | Whiting et al. | 366/246 |
| 988,167 | A | * | 3/1911 | Brannen | 366/270 |
| 1,255,944 | A | * | 2/1918 | Stevens | 366/270 |
| 1,592,713 | A | * | 7/1926 | Bendixen | 366/270 |
| 2,421,191 | A | * | 5/1947 | Durdin | 366/265 |
| 2,690,294 | A | * | 9/1954 | Cary | 417/423.15 |
| 3,709,664 | A | * | 1/1973 | Krekeler et al. | 422/225 |
| 4,566,801 | A | | 1/1986 | Salzman | |
| 8,210,738 | B2 | * | 7/2012 | Hoefken | 366/330.3 |
| 2001/0024400 | A1 | | 9/2001 | Van Der Wel | |

* cited by examiner

*Primary Examiner* — David Sorkin
(74) *Attorney, Agent, or Firm* — RatnerPrestia

(57) ABSTRACT

A mixer assembly comprises a motor, a motor shaft, a propeller connected to the motor shaft and in operation driven by the motor in a first direction of rotation about a propeller axis, the propeller fully submersed in liquid during operation and in rotation generating liquid flow from a suction side to a pressure side of the propeller. Flow control vanes are arranged on the suction side of the propeller, and oriented in an axial plane to deflect the liquid from substantially axial flow into a flow containing a circumferential component of direction which is opposed to the direction of rotation of the propeller. A method for providing axial liquid flow from a mixer propeller that is fully submerged in liquid during operation comprises the steps of applying flow control on the suction side of the mixer propeller through the arrangement of flow control vanes.

12 Claims, 4 Drawing Sheets

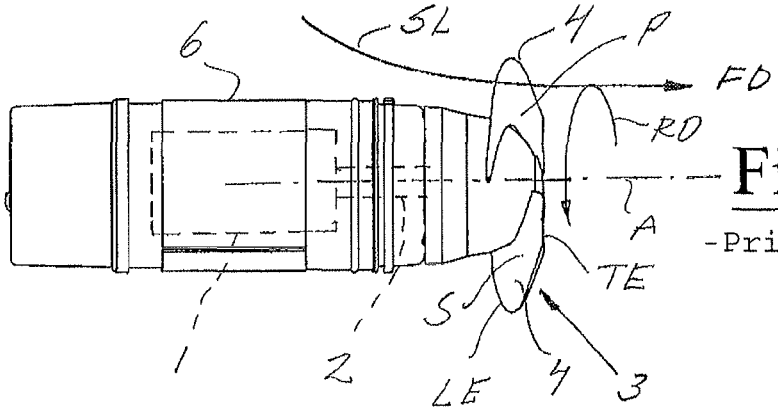
Fig 1
-Prior Art-
Fig 2
-Prior Art-
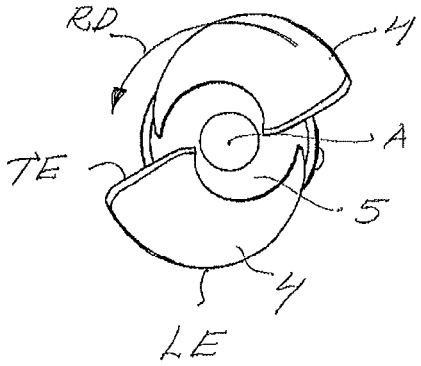
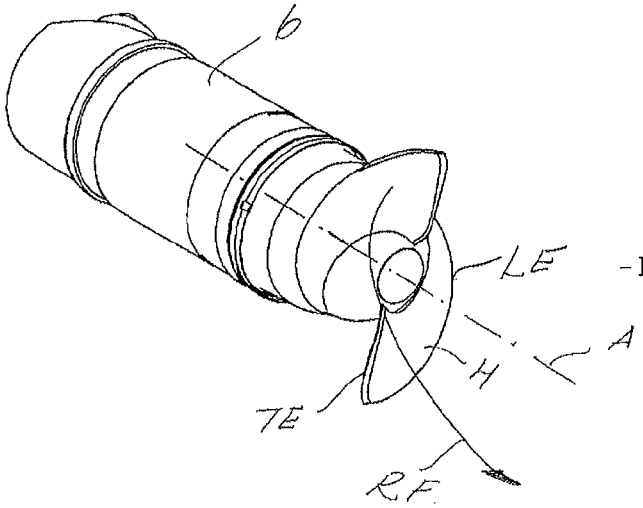
Fig 3
-Prior Art- Fig. 1a
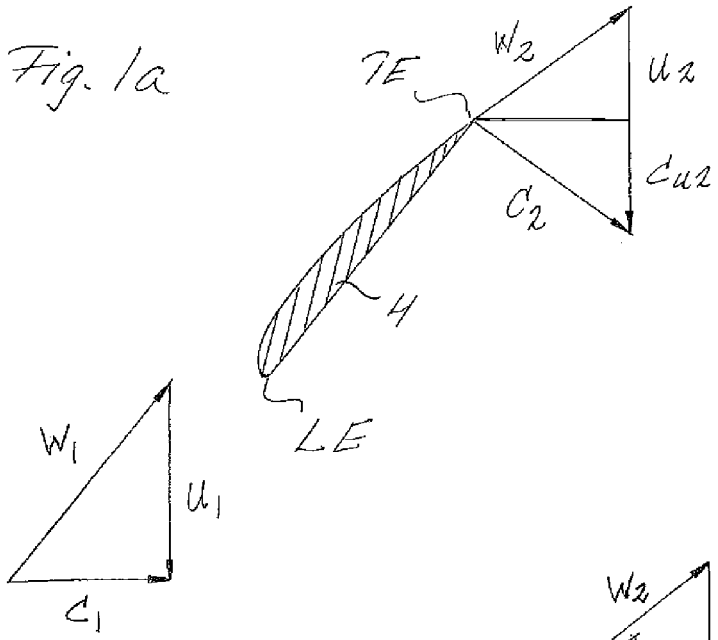
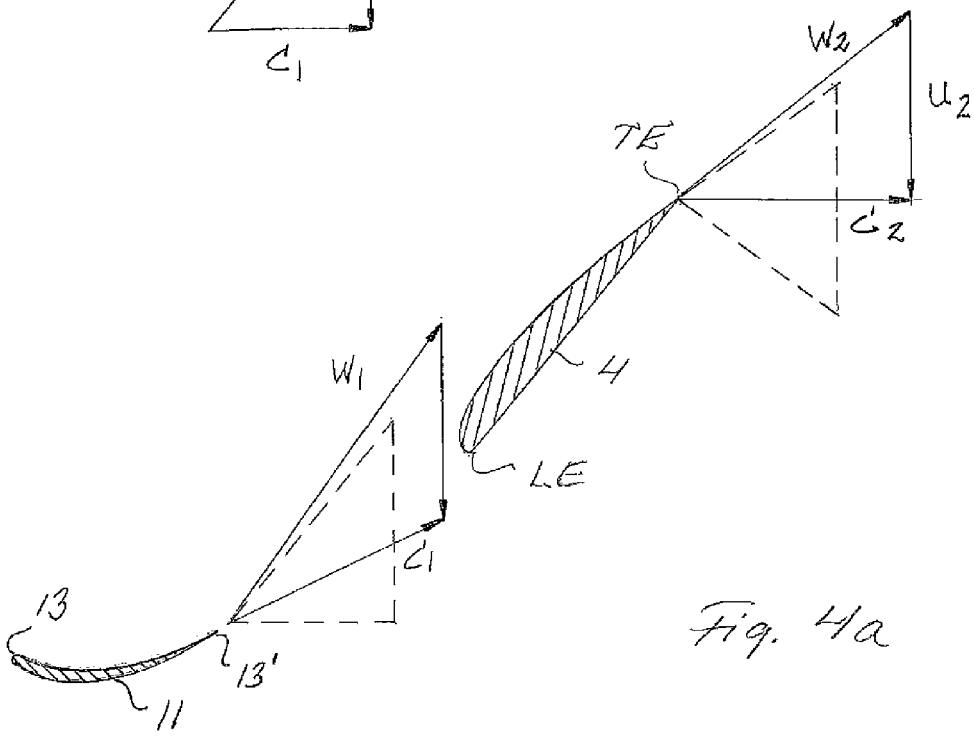
Fig. 4a

MIXER ASSEMBLY AND METHOD FOR FLOW CONTROL IN A MIXER ASSEMBLY

CROSS REFERENCE TO RELATED APPLICATIONS

This application is the U.S. national phase application of PCT International Application No. PCT/SE2009/050012, filed Jan. 12, 2009, which claims priority to Swedish Patent Application No. 0800071-3, filed Jan. 11, 2008, the contents of such applications being incorporated by reference herein.

TECHNICAL FIELD OF THE INVENTION

The present invention relates to mixers arranged to be submersed into a liquid and operable for stirring the liquid by means of a propeller which is driven in rotation. The invention also relates to a method for controlling the flow through a mixer assembly.

BACKGROUND OF THE INVENTION AND PRIOR ART

The mixers referred to are used mainly to generate and maintain a motion within a volume of liquid, in order to prevent sedimentation or agglomeration of solid matter that is dispersed in the liquid, or for de-stratification of liquids having different densities, for homogenization or for the mixing of substances in liquid, etc. Typical implementations, for example, include waste water treatment, water purification, PH-neutralization, chlorine treatment processes, cooling applications, de-icing applications, manure treatment processes.

The typical mixer comprises a propeller that is driven by an electric motor. The motor is contained in a motor enclosure which protects the motor and electrical components from the surrounding liquid. A motor shaft extends from an end of the motor enclosure to mount the propeller's hub in axial relation to the motor and motor enclosure. The opposite end of the motor enclosure may be arranged with mountings by which the mixer can be supported from a wall of a liquid-holding container, albeit other mountings are also conceivable.

The propeller usually has at least two propeller vanes supported from a propeller hub to reach radially with respect to a propeller axis. Alternatively, a singular propeller vane could be arranged to run helically about a propeller hub. In rotation, the propeller causes a drop in pressure on a suction side thereof, and a corresponding raise in pressure on the pressure side. The pressure difference results in a liquid flow through the propeller, from the suction side to the pressure side thereof. Since the pressure side is typically facing from the motor and motor enclosure, the main flow is usually directed axially away from the mixer.

The propeller thus generates in rotation an axial thrust, the size of which is determined by the design of the hydraulic components of the mixer, propeller design, rotational speed, and motor capacity. The stirring result which is related to the capacity of the mixer to generate a circulating flow in a bulk of liquid is largely depending on the efficiency of the mixer to create a jet flow downstream of the propeller. The significance of an extended jet flow is readily appreciated in connection with the stirring of waste water containing solid matter such as fibrous material and heavy organic particles that consume the energy introduced by the mixer.

In the submerged mixers, open to surrounding liquid, the volume/time flow through the propeller is high resulting in a mainly axial flow. The propeller however also generates a rotational motion in the liquid. As the liquid passes through the propeller, the total energy is increased in terms of static pressure and kinetic energy. The static pressure provides the axial thrust, whereas the kinetic energy, which is usually not advantageous in the subject mixer applications, is the result of a rotational component of motion induced in the liquid as it passes the propeller. In order to achieve maximum static pressure/axial thrust, it would thus be desired to suppress the rotation of the liquid that exits from the mixer's propeller.

Propeller vane design in general is a well documented art. It is known (by the Equation of Momentum) that axial thrust is proportional to the increase in axial velocity through the mixer. The magnitude and direction of the flow generated by propeller blades and vanes can be demonstrated by applying velocity triangles to a section of the propeller, as taught by e.g. Stepanoff (1948, reprint 1993): "Centrifugal and Axial Flow Pumps" (Chap. 3.1 and 3.5).

The propeller section considered here for the analysis is a stream surface defined by the rotation RD around the axis A of the "streamline" SL showed in FIG. 1. The streamline SL starts upstream the propeller, passes the propeller blade leading edge LE and ends downstream the trailing edge TE.

FIG. 1*a* shows velocity triangles for a stream surface example, diagrammatically illustrated. The absolute velocity C of liquid, the velocity U of the propeller in rotation and the velocity W of liquid relative to the propeller are related as C=U+W. This way, the absolute velocities C at the leading and trailing edges of the propeller section may be determined for a number of stream surfaces. At the leading edge of the propeller (denoted by index 1), the flow and absolute velocity vector is void of any circumferential component and is therefore parallel to the propeller axis. At the trailing edge of the propeller blade (denoted by index 2), the flow has been brought in rotation by the propeller and a circumferential component (denoted as Cu2) is added to the absolute velocity vector, which is no longer parallel with the propeller axis.

It is previously known from practise to provide a mixer with a ring-shaped envelope about the propeller, known as a jet ring. The purpose and operation of the jet ring is to ensure that liquid is drawn mainly axially into the propeller on the suction side. The ring is typically supported by struts reaching towards the propeller from the motor enclosure. Albeit the ring to some extent contributes to establish a jet flow, the ring and struts are however not contemplated and effective for control or neutralization of a rotational motion in the flow that exits the propeller.

In U.S. Pat. No. 4,566,801, Salzman discloses a submersible mixer comprising a propeller enveloped by a tubular section having baffles downstream of the propeller, and extending axially towards the propeller, i.e. contra the flow direction, from a cruciform arm base which is connectable to the exit end of the tubular envelope. These baffles are optionally used when prevention of a non-axial flow from the tube is occasionally asked for.

The mentioning herein of the Salzman structure is made also for purpose of illustration of another problem that needs to be addressed in the design of submersible mixers for some of the stated uses. Due to the straight leading edges of the cruciform arms and baffles crossing the flow at right angles, Salzman's mixer is susceptible of clogging from fibrous matter and is thus unsuitable for sewage and waste water applications, e.g.

Another problem related with the prior art mixers is air reaching the propeller in result of vortex formation caused as the circumferential flow component imparted by the propeller propagates towards the suction side of the propeller in rotation. The suction of air into the propeller results in a dramatically reduced thrust, i.e. a reduced flow in the axial direction.

Still another problem related with the prior art mixers is torsional stress and vibration resulting from the reactive forces acting on the mixer and its supporting structures.

SUMMARY OF THE INVENTION

The present invention aims generally at providing improved operational characteristics in submersible mixers suitable for stirring in-homogenous liquids.

In at least one embodiment, the present invention provides enhanced axial thrust and extended jet flow from the propeller of a mixer which is submersed in liquid during operation.

The present invention provides a mixer to achieve an axial liquid flow which is void of a rotational component of motion in the exit flow from the mixer's propeller.

In at least one embodiment, the present invention provides enhanced axial thrust and extended jet flow from the propeller of a mixer which during operation is submersed in liquid containing fibrous material and solid matter.

The present invention provides a mixer wherein flow control means are designed to avoid clogging and obstruction from solids included in the liquid.

In at least one embodiment, the present invention provides a mixer avoiding the formation of vortexes that allow air to reach the propeller on the suction side.

In at least one embodiment, the present invention provides a mixer which provides reduced torsional stress and vibration.

Briefly, a mixer assembly according to the present invention comprises a motor; a motor shaft; a propeller connected to the motor shaft and in operation driven by the motor in a first direction of rotation about a propeller axis, the propeller fully submersed in liquid during operation and in rotation generating liquid flow from a suction side to a pressure side of the propeller. The flow control vanes are arranged on the suction side of the propeller, and oriented in an axial plane to deflect the liquid from axial flow into a flow containing a circumferential component of direction which is opposed to the direction of rotation of the propeller.

In preferred embodiments, the flow control vanes are curved when viewed in the axial plane. The flow control vanes may additionally have a compound curvature, thus being curved also in a radial plane perpendicular to the propeller axis.

In at least one embodiment, the flow control vanes are designed with a stream surface which generates in the liquid flow, for each streamline through the propeller, a circumferential velocity component that fully neutralizes a circumferential velocity component generated by a corresponding stream surface of the propeller blade, resulting in an essentially axial exit flow from the propeller.

In a preferred embodiment, the propeller is connected to a motor shaft extending from a motor which is encased in a liquid-tight motor casing and submersed in the liquid during operation. In this embodiment, the pressure side of the propeller blade faces away from the motor casing, and the flow control vanes are supported from the motor enclosure to reach with slanting leading edges towards the suction side of the propeller.

The leading edge of the flow control vane may be designed to have a slanting orientation, far from being orthogonal to the flow direction. This embodiment is advantageous in that clogging caused by solids and fibrous matter comprised in the liquid can be effectively prohibited.

Another advantageous embodiment foresees that a trailing edge of the flow control vane terminates close to the propeller on the suction side. This embodiment not only provides a compact design, but provides also effective flow control on the suction side of the propeller and further reduces propagation of vortex forming rotation in the liquid on the suction side of the propeller.

The number of flow control vanes can be adapted to a subject mixer, preferably at least four to six flow control vanes are arranged and equidistantly spaced about the propeller axis.

In a further aspect of the mixer assembly according to the present invention, a ring-shaped envelope/jet ring may be supported concentrically about the propeller from one or several of the free ends of the flow control vanes. In yet a further aspect of the mixer assembly, the angular orientation of the flow control vanes may be adjustable in relation to the propeller axis.

According to the present invention, a method is provided for generating axial liquid flow from a mixer propeller that is fully submersed in liquid during operation, and via a motor shaft driven by a motor for rotation in a first direction of rotation about a propeller axis, the propeller in rotation generating liquid flow from a suction side to a pressure side of the propeller. The method comprising the steps of:

applying flow control on the suction side of the mixer through the arrangement of flow control vanes, and orienting the flow control vanes for deflection of the liquid from substantially axial flow into a flow containing a circumferential component of direction which is opposed to the direction of rotation of the propeller blade.

In at least one aspect, the method further comprises the step of forming the flow control vanes with stream surfaces that, for each streamline through the propeller, are adapted to a corresponding stream surface of the propeller blade.

BRIEF DESCRIPTION OF THE DRAWINGS

The invention is more closely explained below with reference to the drawings, illustrating an example of a mixer assembly according to the present invention. In the drawings, FIG. 1 is an elevation view showing a mixer according to the prior art;

FIG. 1*a* illustrates diagrammatically velocity triangles of a liquid flow through a stand alone propeller in a mixer of prior art;

FIG. 2 is an end view of the mixer of FIG. 1;

FIG. 3 is a perspective view of the mixer of FIGS. 1 and 2;

FIG. 4*a* illustrates diagrammatically velocity triangles of a liquid flow through a vane and propeller assembly in a mixer according to the present invention;

FIGS. 5*a* and 5*b* illustrate schematically the orientation and shape of flow control vanes included in the mixer assembly;

DETAILED DESCRIPTION OF THE INVENTION

Figure 4:
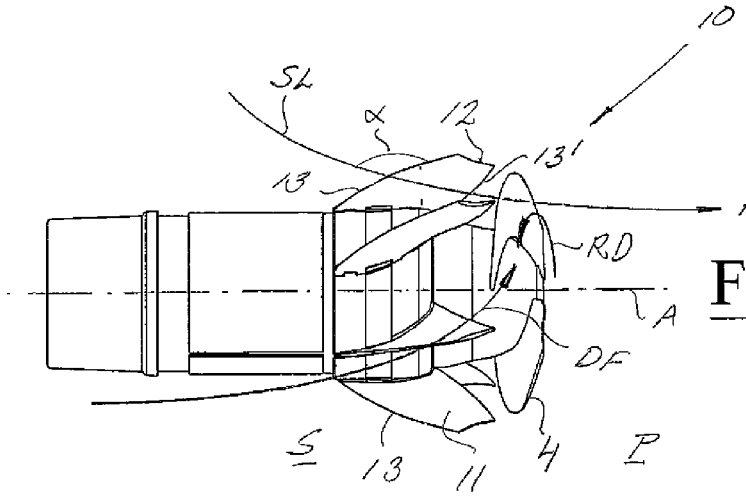
FIG. 4 is an elevation view showing a mixer assembly according to the present invention.

In FIGS. 1-3 a mixer is illustrated, comprising a motor 1 shown in broken lines in FIG. 1, a motor shaft 2 likewise shown in broken lines in FIG. 1, and a propeller 3 connected to the motor shaft 2 and in operation driven in rotation by the motor 1. The propeller 3 comprises propeller blades 4 which are supported from a propeller hub 5, the hub 5 in turn connectable to the motor shaft 2. In the illustrated embodiment the propeller comprises two vanes 4, each of which comprises a pressure side P and a suction side S (see FIG. 1). The direction of rotation is illustrated by the arrow RD in the end view of FIG. 2, the propeller in rotation about a propeller axis A effecting a liquid flow in a direction as is generally illustrated by the arrow FD in FIG. 1. More precisely, and illustrated in FIG. 3, the propeller in rotation imparts to the liquid also a circumferential component of direction, resulting in a non-axial flow as indicated by the arrow RF in FIG. 3.

In the illustrated mixer the motor 1 is enclosed in a liquid-tight casing 6, to which power may be supplied via cables that are omitted from the drawings. Means for supporting the mixer in a fully submerged position in liquid are typically arranged on the casing 6. For purpose of supporting the mixer in liquid, attachment means may be arranged on the casing for suspending the mixer from structures that reach into the liquid from above, or from the bottom or from a wall of a container containing the volume of liquid that is to be treated by the mixer in operation.

The mixer shown in FIGS. 1-3 is to be seen merely as one example of mixers to which the present invention can be implemented. Other designs are thus conceivable, as long as they provide a propeller which in operation is fully submerged into the liquid, and a motor arranged for rotation of the propeller via a motor shaft.

Figure 5:
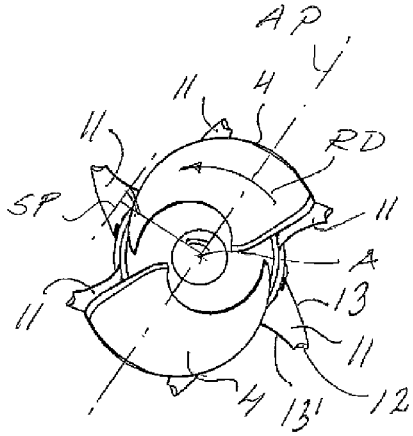
FIG. 5 is an end view of the mixer assembly of FIG. 4.
Figure 6:
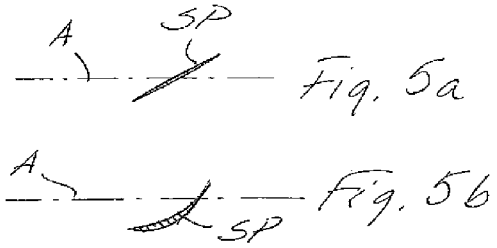
FIG. 6 is a perspective view of the mixer assembly of FIGS. 4 and 5.
Figure 6:
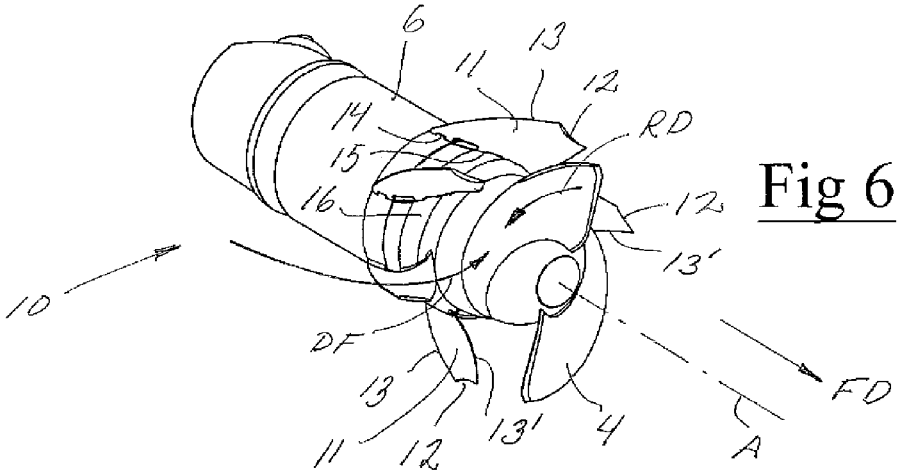

In FIGS. 4-6, a mixer assembly 10 according to the present invention is illustrated. The mixer assembly 10 is shown in connection with the mixer of FIGS. 1-3, albeit as explained above the casing, the motor and propeller components may be otherwise designed. The mixer assembly 10 thus incorporates a motor, a motor shaft and a propeller, in operation generating a flow of liquid from the suction side of the propeller to the pressure side thereof.

In order to enhance an axial exit flow FD from the propeller, flow control vanes 11 are arranged on the suction side S of the propeller. The flow control vanes 11 are oriented to effect deflection of the liquid from a substantially axial flow on the suction side S into a flow which upon entry into the propeller blade contains a circumferential component of direction which is opposed to the direction of rotation RD of the propeller blade. The orientation of the flow control vanes 11 is such, that when a sectional profile SP of a flow control vane 11 is orthogonally projected onto an axial plane AP through the propeller axis, that sectional profile SP has an angular orientation relative to the propeller axis A. The control vanes 11 may have an essentially straight sectional profile SP as illustrated in FIG. 5*a*, or a curved sectional profile SP as illustrated in FIG. 5*b*. In addition, the flow control vanes 11 may have a compound curvature, including a curved sectional profile also in a radial plane perpendicular to the propeller axis A.

FIG. 4*a* shows diagrammatically the result achievable through the introduction of flow control vanes 11 on the suctions side S of the propeller. The flow control vane 11 creates a rotating absolute flow at the propeller inlet (vector C1 comprising a circumferential component). The relative flow vector W is forced to increase as it's direction must remain about parallel to the propeller blade, especially at the propeller blade's trailing edge. A result of this is that the circumferential component at the propeller trailing edge is reduced to zero in the best mode of operation.

In the illustrated embodiment the flow control vanes 11 are supported from the motor casing 6 to extend at a slanting orientation towards the propeller. Connected to the motor casing in the base ends, the control vanes reach with their free ends 12 towards the perimeter area of the propeller. The flow control vanes 11 will typically be equidistantly distributed about the propeller axis A, at a number of at least four and preferably at least six or more flow control vanes.

The flow control vanes 11 are preferably shaped to have a slanting and optionally convex leading edge 13 facing opposite the flow direction of liquid into the propeller, at an angle $\alpha$ substantially larger than 90°. The slanting configuration further improves the ability to prevent solids and fibrous matter from attaching to the flow control vanes 11. The flow control vanes advantageously terminate with a trailing edge 13' positioned close to the propeller on the suction side S.

The connection of the base end of the flow control vane may comprise a mechanism for adjusting the angular orientation of the flow control vanes relative to the propeller axis A. The adjustment mechanism may include pivotal connections 14 between the base end and the motor casing 6, as well as pivotal connections 15 between the base end and a ring member 16 which is rotatably journalled in the motor casing.

Figure 7:
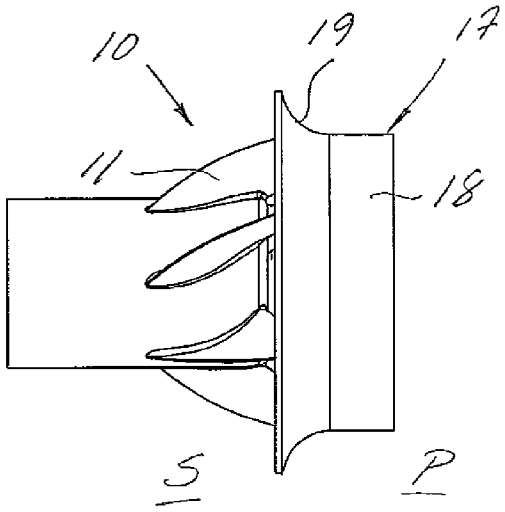
FIG. 7 is an elevation view showing a further development of the mixer assembly of FIGS. 4-6.
Figure 8:
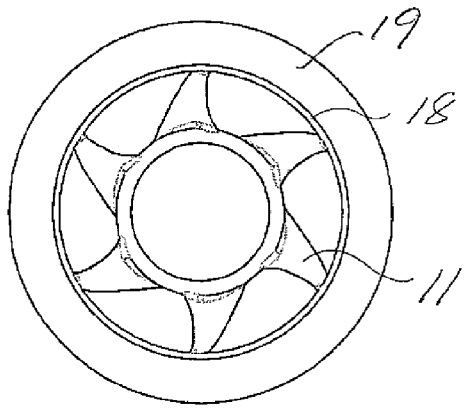
FIG. 8 is an end view of the mixer assembly of FIG. 7.
Figure 9:
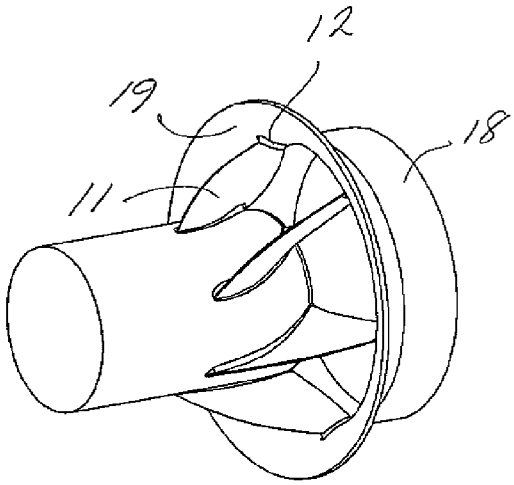
FIG. 9 is a perspective view of the mixer assembly of FIGS. 7 and 8.

In FIGS. 7-9, the efficiency of the mixer assembly 10 is further improved through the application of a ring-shaped envelope 17 concentrically about the mixer's propeller. The envelope or jet ring 17 comprises a straight cylinder section 18 facing towards the pressure side P, and an outwardly flared cylinder section 19 adjoining the cylinder section 18 on the suction side S. As is more readily visible in FIG. 9, the jet ring 17 is supported in one or several of the free ends 12 of the control vanes 11, the free ends connecting to the flared cylinder section 19 of the jet ring.

By applying flow control on the suction side of a submerged mixer propeller in liquid mixing applications as taught herein, an essentially axial flow FD is achievable upon exit from the propeller on the pressure side. Using conventional propeller design teachings, the circumferential component of direction imparted to the flow by the propeller can be essentially fully neutralized when, in each stream surface, the direction of a flow control vane 11 is adapted to the shape of the downstream propeller blade in such a way that the propeller exit flow has no, or an essentially reduced, circumferential component.

In result, the establishment and maintenance of a jet flow and axial thrust provided by the mixer, as well as the efficiency of the mixer, has been substantially enhanced.

Another advantageous effect is achieved from applying flow control on the suction side of a submerged mixer propeller in liquid mixing applications as taught herein. The flow control vanes 11 effectively counteract the rotational moment generated by a propeller in operation, this way reducing to a minimum the torsional stress on attachments and supporting structures that would normally be caused by reactive forces.

Still another advantageous effect is achieved from applying flow control on the suction side of a submerged mixer propeller in liquid mixing applications as taught herein. The flow control vanes 11 effectively counteract the propagation of rotational flow from the propeller to the liquid volume on the suction side of the propeller, which is frequently observed in prior art mixer applications. This way, vortex formation on the suction side is also considerably reduced or avoided through the teachings provided herein.

The advantages provided by controlling the liquid flow on the suction side of the mixer propeller as taught herein can be achieved in modified embodiments of the mixer assembly. One modification includes, for example, a bevel gear transmission submerged together with the mixer propeller and driven by a motor which is supported above the liquid. In such embodiment, the flow control vanes can be supported on the bevel gear transmission. In other modifications, the flow control vanes can be supported, for example, from a motor shaft encasing separated from the motor encasing. Still another embodiment foresees that the flow control vanes are supported from a separate structure positioned on the suction side of the propeller, such as a structure attached to the liquid container. As will also be realized by the skilled person, one or several of the features disclosed above and related to different aspects of the invention can be applied separately or in different combinations, each advantageous feature providing additional benefit to the solution as defined in independent claims.

The invention claimed is:

1. A mixer assembly comprising a motor encased in a liquid-tight motor casing and submersed in liquid during operation, a motor shaft extending from the motor, a propeller connected to the motor shaft and in operation driven by the motor in a first direction of rotation (RD) about a propeller axis (A), the propeller fully submersed in the liquid during operation and in rotation generating liquid flow from a suction side (S) to a pressure side (P) of the propeller, wherein flow control vanes connected at a base end to a non-rotating structure are arranged on the suction side of the propeller, and oriented in an axial plane to deflect the liquid from substantially axial flow into a flow (DF) containing a circumferential component of direction which is opposed to the direction of rotation (RD) of the propeller.

2. The mixer assembly of claim 1, wherein the flow control vanes are curved in the axial plane.

3. The mixer assembly of claim 2, wherein the flow control vanes are curved also in a radial plane perpendicular to the propeller axis.

4. The mixer assembly of claim 2, wherein the flow control vanes are designed with stream surfaces which generate in the liquid flow, for each streamline (SL) through the propeller, a circumferential velocity component that fully neutralizes a circumferential velocity component generated by a corresponding stream surface of the propeller blade.

5. The mixer assembly of claim 1, wherein the pressure side (P) of the propeller faces away from the motor casing, and the flow control vanes are supported from the motor casing to reach with a slanting leading edge towards the suction side (S) of the propeller.

6. The mixer assembly of claim 5, wherein a trailing edge of the flow control vane terminates close to the propeller.

7. The mixer assembly of claim 1, wherein at least four flow control vanes are equidistantly spaced about the propeller axis (A).

8. The mixer assembly of claim 7, wherein a ring-shaped envelope is supported concentrically about the propeller from one or several of the free ends of the flow control vanes.

9. The mixer assembly of claim 1, wherein the angular orientation of the flow control vanes relative to the propeller axis (A) is adjustable.

10. A method for providing axial liquid flow (FD) from a mixer propeller that is fully submersed in liquid during operation, the propeller connected to a motor shaft extending from and driven by a motor for rotation in a first direction of rotation (RD) about a propeller axis (A), the motor encased in a liquid-tight motor casing, the propeller in rotation generating liquid flow from a suction side (S) to a pressure side (P) of the propeller, the method comprising the steps of:

applying flow control on the suction side (S) of the mixer propeller through the arrangement of flow control vanes connected at a base end to a non-rotating structure, and orienting the flow control vanes for deflection of the liquid from substantially axial flow into a flow (DF) containing a circumferential component of direction which is opposed to the direction of rotation (RD) of the propeller.

11. The method of claim 10, wherein through the step of forming the flow control vanes with stream surfaces which, for each streamline (SL) through the propeller, is adapted to a corresponding stream surface of the propeller blade.

12. The method of claim 10, wherein the pressure side (P) of the propeller faces away from the motor casing, and the flow control vanes are supported from the motor casing to reach with a slanting leading edge towards the suction side (S) of the propeller.

* * * * *